United States Patent [19]

Sato et al.

[11] Patent Number: 4,560,087

[45] Date of Patent: Dec. 24, 1985

[54] LABEL PEELING DEVICE FOR LABEL ISSUING MACHINE

[75] Inventors: Yo Sato, Tokyo; Tadao Kashiwaba, Iwate; Masaru Sakurai, Saitama; Yasuhiko Matsuda; Koichi Kondo, both of Iwate, all of Japan

[73] Assignee: Kabushiki Kaisha Sato, Japan

[21] Appl. No.: 452,705

[22] Filed: Dec. 23, 1982

[30] Foreign Application Priority Data

Dec. 28, 1981 [JP] Japan ..... 56-210022
Feb. 3, 1982 [JP] Japan ..... 57-14995

[51] Int. Cl.[4] ..... B65H 5/28; B65C 9/42; B65C 11/02

[52] U.S. Cl. ..... 221/73; 221/13; 156/384; 156/577; 156/584; 156/DIG. 33

[58] Field of Search ..... 156/DIG. 24, DIG. 28, 156/DIG. 33, DIG. 37, DIG. 42, DIG. 44, DIG. 45, DIG. 46, DIG. 47, DIG. 49, 384, 577, 579, 584; 221/13, 69, 70, 71, 72, 73

[56] References Cited

U.S. PATENT DOCUMENTS

| | | | |
|---|---|---|---|
| 2,754,994 | 7/1956 | Cole | 221/73 |
| 2,933,216 | 4/1960 | Cole | 221/73 |
| 3,044,535 | 7/1962 | Krueger | 156/584 |
| 3,107,193 | 10/1963 | De Neui et al. | 156/584 X |
| 3,169,895 | 2/1965 | Sohn | 221/73 X |
| 3,461,018 | 8/1969 | Nagashima | 156/384 |
| 3,530,028 | 9/1970 | Messmer | 156/584 |
| 4,026,758 | 5/1977 | Sato | 156/584 |
| 4,301,729 | 11/1981 | Fujita | 156/584 X |

FOREIGN PATENT DOCUMENTS 1511892 7/1979 Fed. Rep. of Germany .

*Primary Examiner*—Joseph J. Rolla
*Assistant Examiner*—Louise S. Heim
*Attorney, Agent, or Firm*—Ostrolenk, Faber, Gerb & Soffen

[57] ABSTRACT

The disclosure concerns a label peeling device for use with a label issuing machine, such as a hand labeler or a measuring printer. There is a feed unit for feeding a label web, which web comprises a plurality of labels temporarily adhered in series to a web of backing paper. A peeling unit turns and deflects the backing paper web rearwardly, as it is being fed by the feed unit, and the labels peel one by one from the backing paper at the line of deflection due to the rigidity of the labels. An auxiliary label peeling member is arranged in the vicinity of that portion of the peeling unit at which the backing paper and the labels separate. In some embodiments, the auxiliary peeling member has a label abutment portion so placed, shaped and sized that any label which might fail to peel from the backing paper merely by the reverse turning of the backing paper web is moved to abut the label abutment portion until it is forcibly peeled from the backing paper. The auxiliary peeling member comprises a rotary member which is rotatable in the advancing direction of the labels. Any label, which might otherwise fail to peel off, abuts and rides over the rotary member. In another embodiment, a scraper reciprocates toward the deflection line along the surface of the backing paper from which the labels are peeled for peeling any label off the backing paper web.

2 Claims, 31 Drawing Figures

LABEL PEELING DEVICE FOR LABEL ISSUING MACHINE

BACKGROUND OF THE INVENTION

The present invention relates to a label peeling device for use with a label issuing machine such as a label printing and applying machine (hereafter called a hand labeler) or a measuring printer, and more particularly relates to a label peeling device which aids in separating a label from its web of backing paper at the location where the backing paper web is reversed for label peeling.

Hand labelers, measuring printers or other label issuing machines may issue labels from a strip of labels adhered to a web of backing paper. Both the label strip and the backing paper web are of flexible paper.

In order to reduce the production cost for the entire label web, however, efforts have been made to use labels and backing paper which are comprised of inexpensive and coarse material and/or of thinner and thus more flexible material. Such labels may be less likely to separate from the backing paper. In order to enable the labels to be more easily peeled from their backing paper, moreover, other attempts have been made to apply a thin and rough layer of a parting agent to that side of the backing paper to which the labels are temporarily adhered. This is to be distinguished from the carefully smoothed, appropriately thick parting agent layer that has previously been required. But, because of the less careful manner of applying a parting agent that is now being tried, the rigidity of the labels themselves have nonuniformly deteriorated. Further, the parting agent soaks into the backing paper, because this paper is coarse, so that the parting agent layer becomes thinner, and still worse, the applied parting agent layer becomes irregular. All of this has caused the labels to frequently fail to be completely peeled from their backing paper web when this backing paper web is turned in the reverse direction at the label peeling unit. Labels which fail to be peeled from their backing paper web not only fail to be issued from the machine but they also stick to the feed passage in the machine for the backing paper and thereby make the machine inoperative or cause problems.

Efforts have been made in the past to lift labels, or the like, off a backing paper web. See U.S. Pat. Nos. 2,912,140; 3,007,919; and 3,169,895. But assured peeling, without resistance to label separation, is not provided by these prior products.

SUMMARY OF THE INVENTION

It is, therefore, an object of the present invention to provide such a label peeling device for use with a label issuing machine which avoids the above-described problems.

Another object of the present invention is to provide a label peeling device which peels labels from their backing paper without fail.

It is a further object of the invention to provide such a label peeling device which is useful with flexible, nonuniform labels, even if the label web is produced at low cost, or if there is varying and somewhat unpredictable temporary adhesion between the labels and the backing paper.

In order to achieve those objects, the present invention provides a label peeling device for a label issuing machine. That machine includes a supply unit for supplying a label web comprising a strip of a plurality of labels temporarily adhered in series to a continuous web of backing paper. The label peeling device comprises a feed unit for feeding the label web from the supply unit and comprises a peeling unit for deflecting and particularly for reversely turning the backing paper web, which is being advanced in the reverse direction. This should peel the labels one by one from the backing paper at the turning location, due to the rigidity of the labels themselves. Since the labels may not always separate from the backing paper web as they should, an auxiliary label peeling member is arranged in the vicinity of the peeling unit for effecting separation of the labels from the backing paper web, by acting upon the labels from below.

In some embodiments, the auxiliary peeling member comprises a label abutment which is positioned, shaped and sized so that any label, which might otherwise fail to be peeled off merely by the reverse motion of the backing paper, is moved to abut the label abutment portion of said auxiliary peeling member as the label web is advanced, and the undersurface of the label, which carries adhesive, rides over the abutment portion. The contact of the label with the abutment portion forcibly peels the label from the backing paper.

In one preferred embodiment, the auxiliary peeling member comprises a rotary member, which is rotatable in the advancing direction of the label web so that a label, which fails to be peeled off the backing paper, abuts and rides over the rotary member and causes the rotary member to rotate as the label advances over it until the label is peeled off the backing paper web. The rotary member rotates freely without any effective resistance to rotation for aiding advance of the peeled off label and also avoiding bending, wrinkling or adhering of the label on the rotary member.

The spacing between the direction reversal or deflection line of the backing paper web and the auxiliary peeling member should be small enough that a label will not be able to travel with the backing paper around the direction reversal line without contacting the auxiliary label peeling device.

In a further aspect of the invention, the label strip is indexed by the label feed unit so that at the conclusion of each advance of the label web by one label, the leading end portion of the next label to be separated from the backing strip is at, or is abutting and has just begun to pass over, the auxiliary label peeling device. Then at the next label web advance, that label will separate from the backing strip with certainty.

In a further embodiment, the auxiliary label peeling device comprises a scraper which is reciprocated along the surface of the backing paper web from a position away from the deflection line toward the label deflection line for scraping any labels off the backing paper web which fail to peel off the backing paper and instead travel around the deflection line with the backing paper.

BRIEF DESCRIPTION OF THE DRAWINGS

Other objects and features of the present invention will become apparent from the following description of various embodiments of the invention with reference to the accompanying drawings, in which:

FIGS. 2–5 show a first embodiment of the present invention, in which FIG. 2 is a partial, longitudinal sectional view showing this embodiment of the present invention applied to a hand labeler;

FIG. 3 is a perspective view showing an essential portion of the invention, including an auxiliary peeling member;

FIG. 4 is a sectional side view showing the operating state of the invention, including an auxiliary peeling member; and FIG. 5 is a perspective view showing a modification of an auxiliary peeling member;

FIGS. 6–8 show a second embodiment of the present invention, in which FIG. 6 is a partial, longitudinal, sectional view showing this embodiment of the present invention applied to a hand labeler;

FIG. 7 is a perspective view showing an essential portion of the invention, including an auxiliary peeling device; and FIGS. 8A, 8B and 8C are schematic side views sequentially showing the operating states of this embodiment;

FIGS. 9–12 show a third embodiment of the present invention, in which FIG. 9 is a partial, longitudinal, sectional view showing this embodiment of the present invention applied to a printer;

FIG. 10 is a perspective view showing an auxiliary peeling member of this embodiment; and FIGS. 11 and 12 are respective front and side elevational views showing modifications of the auxiliary peeling member;

FIGS. 13–19 show a fourth embodiment of the present invention, of which FIG. 13 is a partial, longitudinal sectional view showing this embodiment of the present invention applied to a printer;

FIG. 14 is a perspective view showing an auxiliary peeling member of this embodiment;

FIG. 15 is a block diagram showing a circuit for driving and controlling the printer;

FIG. 16 is a timing chart showing the operations of essential portions of the printer; and FIGS. 17–19 are side elevational views showing modifications of the auxiliary peeling member of this embodiment and showing a construction for driving the same;

FIGS. 20–26 show a fifth embodiment of the present invention, of which FIG. 20 is a partial, longitudinal sectional view showing this embodiment of the present invention applied to a hand labeler;

FIG. 21 is a perspective view showing an essential portion of this embodiment;

FIG. 22 is a longitudinal sectional view showing the operating state; and

FIGS. 23–26 are front elevational views showing modifications of an auxiliary peeling device in the form of a rotary member; and FIGS. 27–29 show a sixth embodiment of the present invention, of which FIG. 27 is a partial, longitudinal sectional view showing this embodiment of the present invention applied to a printer;

FIG. 28 is a perspective view showing an auxiliary peeling device in the form of a rotary member; and FIG. 29 is a longitudinal, sectional view showing the operating state.

DESCRIPTION OF THE PREFERRED EMBODIMENTS

Figure 1:
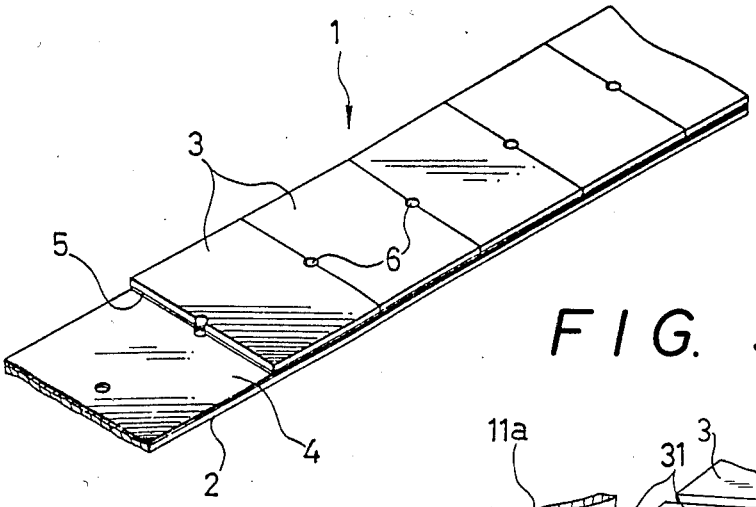
FIG. 1 is a perspective view showing one example of a label web with which the invention may be used.

FIG. 1 shows one form of a label web 1 which may be used in conjunction with the present invention. The label web 1 is comprised of an elongate web of backing paper 2 and a plurality of separate labels 3 which are temporarily adhered in series to the backing paper 2. To that side of the backing paper 2 to which the labels 3 are temporarily adhered, there is applied a layer of parting agent 4 which is made of a silicone resin, or the like, so as to make it easy for the labels 3 to be peeled off. To the back of each label 3, on the other hand, there is applied a layer of adhesive 5 by which the label 3 is temporarily adhered to the backing paper 2. At a pitch equal to the length of each label 3, the label web 1 is formed with feeding perforations 6 which extend through both the backing paper 2 and the respective labels 3.

FIGS. 2–5 show the first embodiment of the present invention, in which the label peeling device according to the present invention is applied to the hand labeler. In this embodiment, an auxiliary peeling member 33 is arranged in a stationary position in the vicinity of a label peeling unit 30.

At the rear of the labeler body 11, a grip 12 is formed which integrally extends from the body 11. Below the grip, a hand lever 13 is hinged to both opposite side plates 11*a* and 11*b* of the body by a pivot pin 14.

Integrally extending from the front portion of the hand lever 13, there is a bifurcated actuating lever 15 which holds a printing head 16 at its front end. This printing head 16 includes a plurality of type wheels 17, each formed with types 17*a* on its outer circumference. The wheels 17 are juxtaposed so that the types 17*a* bearing the desired indicia to be printed can be selected by turning the respective type wheels 17. Before the printing operation ink is applied to the selected types 17*a* of the respective type wheels 17 by an inking roller 18.

Spring anchoring members 19 and 20 are formed respectively at the rear portion inside of the grip 12 and at the upper portion of the front end of the hand lever 13. Between those spring anchoring members 19 and 20, a tensioned return spring 21 is anchored, which always urges the hand lever 13 and the actuating lever 15 to pivot clockwise, as viewed in FIG. 1.

Above the body 11, there is an integral attached supply unit 22 for the label web 1, which holds the label web 1 in rolled form. This label web 1 held on the supply unit 22 is unrolled and supplied to a label peeling device 23.

The label peeling device 23 includes a feed unit 24 for suitably feeding the label web 1 from the supply unit 22 to the printing head 16, the peeling unit 30 for deflecting the backing paper by turning the then forwardly moving web of backing paper 2 rearwardly, in the vicinity of the lower end of the front portion of the body 11. This should peel the labels 3 from the backing paper 2 due to the rigidity of the labels themselves. This peeling is assured by the auxiliary peeling member 33 which is arranged in the vicinity of the peeling unit.

The feed unit 24 is equipped with a feed drum 26, which is rotatably supported on an axle 25 that is supported between the side plates 11*a* and 11*b* of the body 11. The feed drum 26 has a plurality of feed pins 26*a* formed on its outer circumference, which are equidistantly spaced, to engage in the respective correspondingly spaced perforations 6 of the label web 1. One lateral side of the drum 26 carries engagement pins 26*b*, which are the same in number as the feed pins 26*a*. The pins 26*b* are engaged by a hook 27. One end of the hook 27 is hinged to the movable actuating lever 15 by a pivot pin 28. The other end of the hook 27 engages one of the engagement pins 26*b* to suitably turn the feed drum 26 in accordance with the reciprocating swings of the actuating lever 15 thereby to advance and feed the label web 1. A spring 29 urges the hook 27 toward the engagement pins 26*b*.

Figure 3:
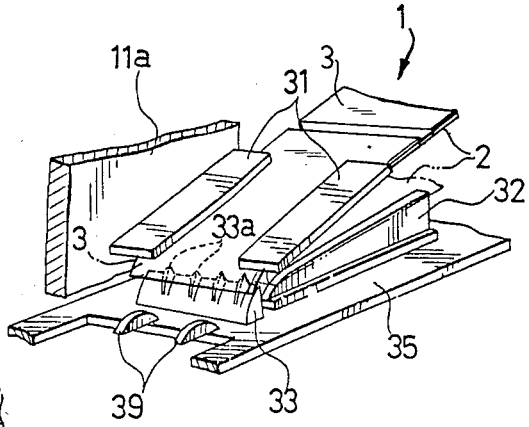
Figure 4:
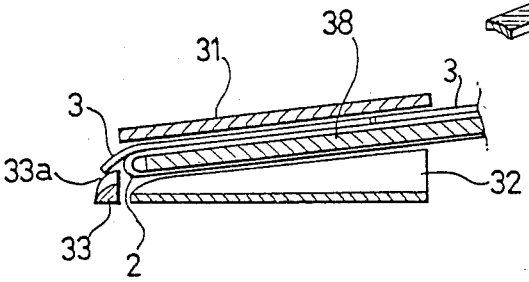
Figure 2:
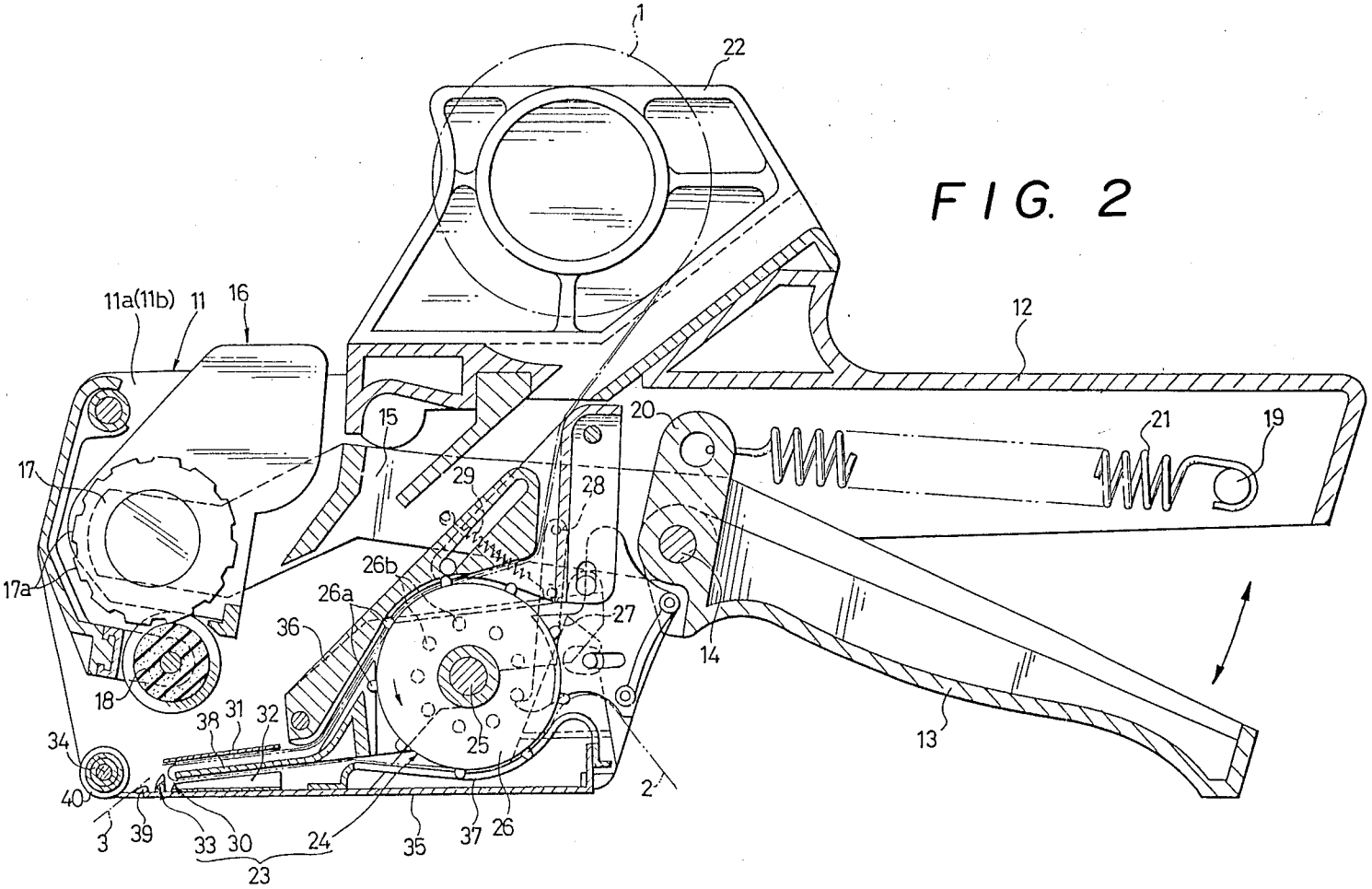

As shown in FIGS. 2 and 3, the peeling unit 30 is equipped with upper regulating members 31, which are respectively formed integrally with the side plates 11*a* and 11*b* of the body 11, and with a lower regulating member 32 which is mounted on a bottom cover 35 that is hinged to the body 11 by a pivot pin 34 at the front of the body. The upper regulating members 31 and the lower regulating member 32 are juxtaposed to define a small gap in which the web of backing paper 2 of the label web 1 is turned rearwardly, so that the labels 3 are peeled one by one from the backing paper 2 due to the rigidity of the labels.

The auxiliary peeling member 33 is arranged in the vicinity of the peeling unit 30, as shown in FIGS. 2 and 3. It is either integral with the bottom cover 35 or is fixed to it by means of an adhesive or screws. The auxiliary peeling member 33 is integrally formed at its upper portion with a label abutment portion 33*a*, which is composed of a plurality of ridges so as to reduce its contact area with the labels 3. The label abutment portion 33*a* has its leading upstream tips positioned in the vicinity of the front of the peeling unit 30, at which the labels 3 are to be peeled from the backing paper 2. The auxiliary peeling member 33 preferably has at least its label abutment portion 33*a* coated with a silicone resin, or the like, so as to prevent the labels 3 from sticking to it.

Guide members 36 above the drum 26 guide the perforations 6 of the label web 1 as a whole before the labels peel off and guide members 37 below the drum 26 guide the perforations 6 of only the backing paper 2 after label peeling in their respective engagements with the feed pins 26*a* of the feed drum 26. A platen 38 receives the printing pressure of the printing head 16. There is a temporary holding member 39 just forward of the line of deflection of the backing paper for temporarily holding the label 3 that has just been peeled. An applying roller 40 forward of the holding member 39 is rotatably carried on the pivot pin 34 for applying the label 3 (that is being temporarily held on the temporary holding member 39) to a commodity, or the like, to be labeled.

Next, the operation of the foregoing embodiment is explained. When the hand lever 13 is squeezed toward the grip 12, it is moved counterclockwise (as viewed in FIG. 2) together with the actuating lever 15 against the force of the return spring 21. The rotational motion of the actuating lever 15 carries the printing head 16 down so that the selected types 17*a* of the respective type wheels 17 receive ink from the inking roller 18 and then print the label 3 that is lying on the platen 38.

When the hand lever 13 is released, the hand lever 13 and the actuating lever 15 are rotated clockwise, as viewed in FIG. 2, by the return spring 21. This carries the printing head 16 up into its initial position. This also rotates the feed drum 26 of the feed unit 24 counterclockwise, which feeds the label web 1 along the upper circumference of the feed drum and feeds the turned back backing paper 2 along the lower circumference of the feed drum.

The label web 1 thus being fed by the feed unit 24 has only its backing paper 2 deflected or turned rearwardly at the peeling unit 30. As a result, the printed label 3 peels from the backing paper 2 by its own rigidity and the label is temporarily held on the temporary holding member 39 until it is applied to a commodity, or the like, by applying roller 40.

Sometimes, not all of the labels 3 are completely peeled from the backing paper 2 as the backing paper 2 is turned rearwardly at the peeling unit 30. Instead, some labels turn together with the backing paper 2. This is because the labels 3 may have low rigidity due to their material and/or they may be temporarily adhered to the backing paper 2 excessively firmly due to the qualities or applied states of the peeling agent 4 and the adhesive 5, which are applied respectively to the backing paper 2 and the labels 3.

The auxiliary peeling member 33, formed with the label abutment portion 33*a*, is therefore provided. Any label 3, which is not completely peeled from the backing paper 2 but instead attempts to turn together with the backing paper 2, is peeled off because its leading end portion abuts against the label abutment portion 33*a* of the auxiliary peeling member 33, as seen from FIG. 4.

The perforations 6 are so placed in the label web 1 with respect to the equally spaced leading ends of the labels and the drum has its pins 26*a*, 26*b* so placed that the labels are indexed during each squeeze of the handle 12 so that after a label has been fed to the applying roller, the next label is positioned so that its leading edge overlies or is just beginning to ride over the label abutment portion 33*a*. This assures separation of the next label from the backing paper on the next label web advance.

Figure 5:
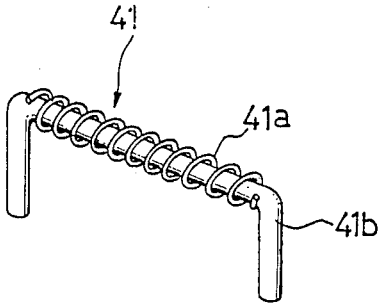

Although the auxiliary peeling member 33 is shown formed integrally with the label abutment portion 33*a*, the auxiliary peeling member 33 may be modified to the form of an auxiliary peeling member 41 of FIG. 5, wherein a coiled element made of metal wire provides the label abutment portion 41*a* and is wound on the intermediate portion of a generally C-shaped pin 41*b*. This alternative is further developed as the fifth embodiment of FIGS. 20–26. Alternatively, the auxiliary peeling member may have the pin 41*b* serve directly as the label abutment portion.

Figure 6:
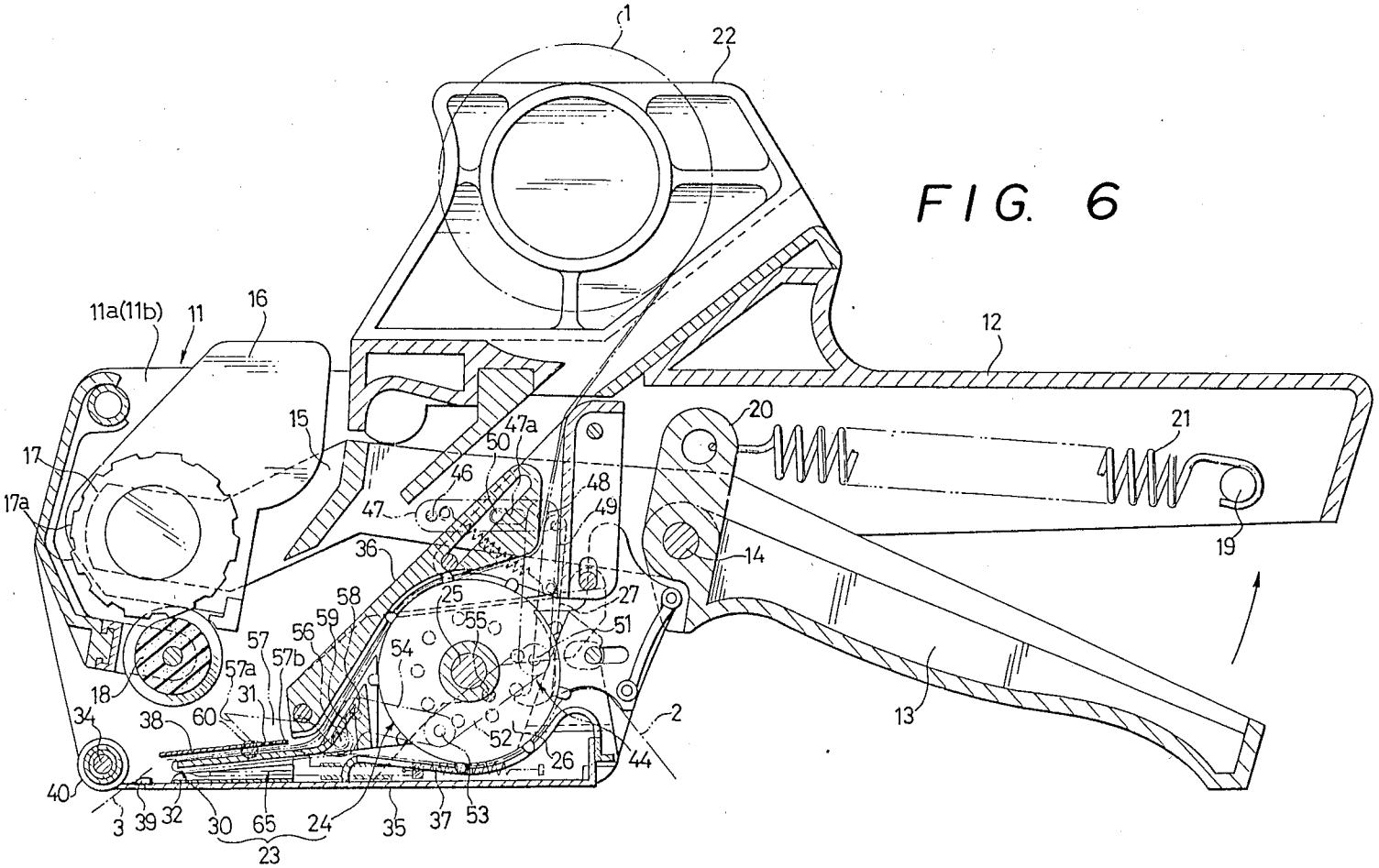
Figure 7:
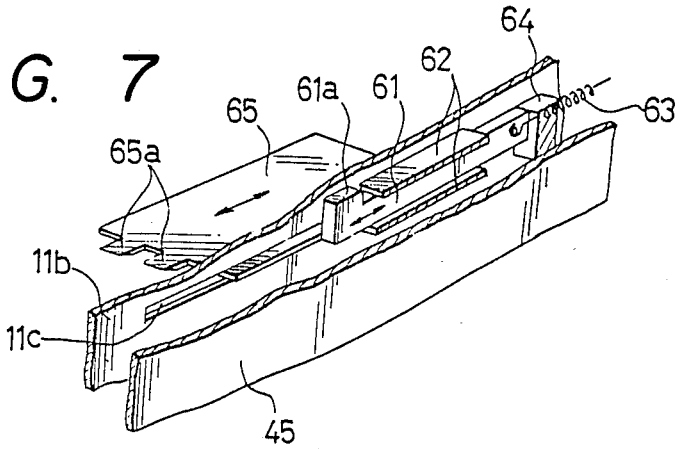
Figure 8:
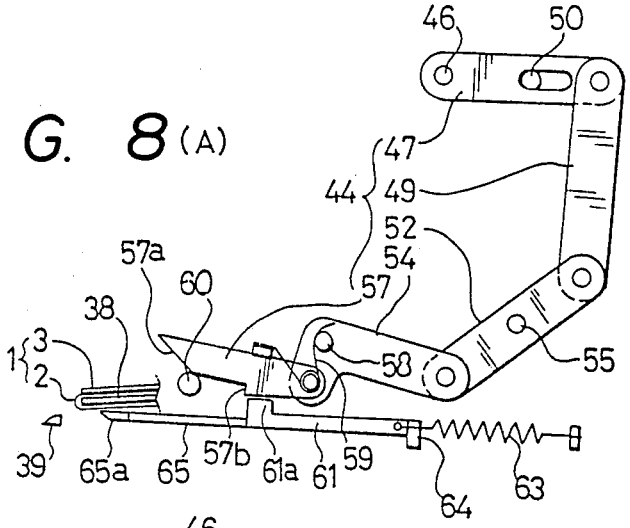
Figure 8:
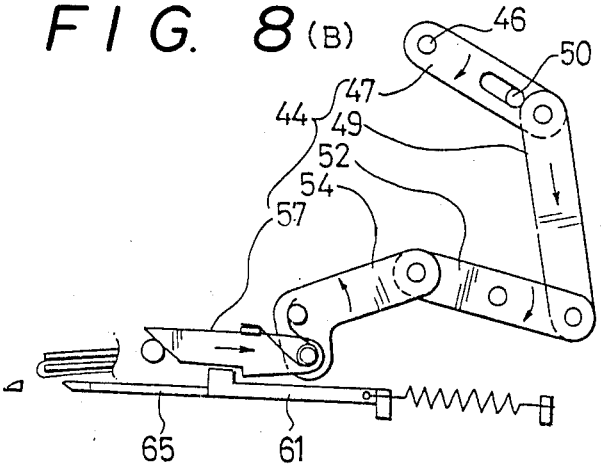
Figure 8:
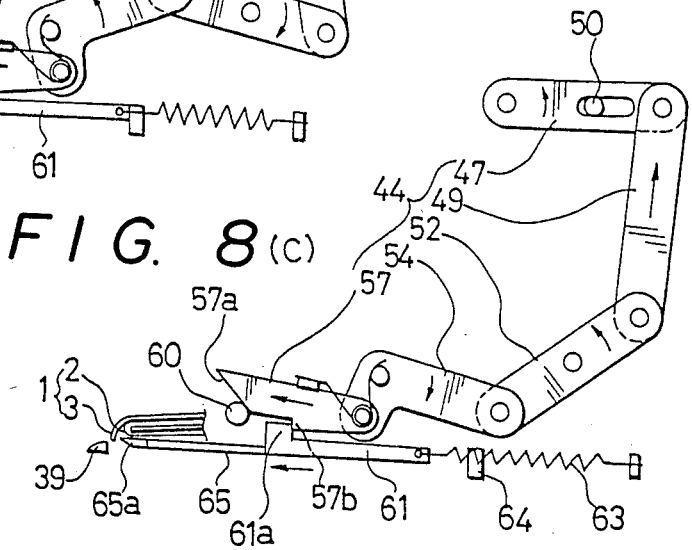

In the second embodiment of label peeling device shown in FIGS. 6–8, an auxiliary peeling member 65 in the vicinity of the peeling unit 30 reciprocally moves in accordance with the operations of the hand lever 13. The elements of this embodiment corresponding to elements of the first embodiment are not explained again, but are instead indicated by the same reference numerals as those of the foregoing first embodiment.

As shown in FIGS. 6 and 7, a cover 45 is disposed laterally outside of and at a suitable spacing from one side plate 11*b* of the labeler body 11. Laterally inside of the cover 45, there is a link mechanism 44 which is comprised of three levers 47, 52 and 54, an arm 49 and a hook 57. At the inner side of the cover 45, there is a pivot pin 46 to which one end of the lever 47 is hinged. The other end of the lever 47 is pivotally joined to one end of the arm 49 by a pin 48. The intermediate portion of the lever 47 has a slot 47*a* formed in it, in which a pin 50 is slidably fitted. One end of the pin 50 is anchored at the actuating lever 15 and extends through a slot (not shown) of the side plate 11b into the slot 47a of the lever 47.

The other end of the arm 49 is pivotally joined by a pin 51 to one end of the lever 52. The other end of the lever 52 is pivotally joined by a pin 53 to the L-shaped lever 54 and its middle portion is hinged by a pivot pin 55 to the cover 45. The other end of the lever 54 is pivotally joined by a pin 56 to the hook 57, while the middle portion of the lever 54 is hinged by a pivot pin 58 to the cover 45. The other end of the hook 57 has an inclined cam surface 57a. The intermediate portion of the hook is formed with a retaining portion 57b at its lower portion. The hook 57 is biased counterclockwise in FIG. 6 by a spring 59 so that its cam surface 57a is always forced into partial contact with a pin 60 which is anchored at the cover 45.

A sliding member 61 on the outward side of the side plate 11b is arranged below the hook 57. The member 61 has an integral upstanding protrusion 61a that can be brought into and out of engagement with the downwardly extending retaining portion 57b of the hook 57. The sliding member 61 is slidable forwardly toward the line of deflection of the label web and rearwardly, guided by a pair of guide plates 62 which are mounted on the cover 45. The sliding member 61 is urged rearwardly by a spring 63, which is mounted under tension between the sliding member 61 and the back of the cover 45. Rearward motion of the sliding member is usually stopped when its rear end abuts against a stopper 64 on the cover 45.

The sliding member 61 on the outward side of the side plate 11b is integrally attached through the elongate slot 11c in the plate 11b with the plate-shaped, horizontally oriented, auxiliary peeling member 65, which extends forwardly from behind the peeling unit 30 to the vicinity of the peeling unit 30 below the platen 38 and below the surface of the backing paper from which the labels are peeled. The front end of the auxiliary peeling member 65 is formed integrally with a label abutment portion 65a including two teeth. When the auxiliary peeling member 65 is moved forward together with the sliding member 61, the teeth 65a move forward to the position where the backing paper 2 leaves the labels 3, i.e. the line of deflection of the backing paper.

The printing of the labels 3, the feeding of the label web 1, etc. are identical to those of the first embodiment. With reference to FIGS. 8A, 8B and 8C, the operations of the auxiliary peeling member 65, which is reciprocally movable back and forth in accordance with the operations of the hand lever 13, is described.

In the released state of the hand lever 13, the auxiliary peeling member 65 is stopped in its rearward position shown in FIG. 8A. When the hand lever 13 is squeezed and the label 3 is printed, the pin 50 on the hand lever is moved down and the link mechanism 44 moves in the directions of arrows in FIG. 8B, which retracts the hook 57 rearwardly. Meanwhile, both the sliding member 61 and the auxiliary peeling member 65 are left inoperative in their rearward position.

When the hand lever 13 is next released, the label web 1 is fed by the feed drum 26 to start the peeling operation of the label 3. Also, this raises the pin 50. The rise of the pin 50 moves the link mechanism 44 components in the return directions shown by the arrows in FIG. 8C. The hook 57 advances while its lower retaining portion 57b engages the upraised protrusion 61a of the sliding member 61. This also advances the auxiliary peeling member 65 against the biasing force of the spring 63. The label abutment portion 65a of the auxiliary peeling member 65 scrapes off and pushes upon the leading end portion of any label 3, which has not completely peeled from the backing paper 2 but is instead about to turn rearwardly with the backing paper 2. It peels that label 3 from its backing paper 2 to temporarily hold the label on the temporary holding member 39.

As the hook 57 advances, it is turned slightly clockwise, as viewed in FIG. 8, by the coaction between its inclined cam surface 57a and the pin 60. The retaining portion 57b is eventually raised off the protrusion 61a of the sliding member 61 immediately after the label abutment portions 65a of the auxiliary peeling member 65 has pushed the label 3. The now freed sliding member 61 is retracted by the biasing force of the spring 63 until its rear end abuts against the stopper 64. At the same time, of course, the auxiliary peeling member 65 is also retracted. Moreover, when the hand lever 13 is returned to its initial position, the link mechanism 44 is also restored to its initial position shown in FIG. 8A.

Alternatively, the auxiliary peeling member 65 of the second embodiment may be modified so that it is normally positioned in a forward position, is retracted rearwardly by squeezing of the hand lever 13, and is returned to the front position, simultaneously with the feeding of the label web 1, by the release of the hand lever 13. With this construction, the auxiliary peeling member 65 helps peeling of the label 3, while the member 65 is being returned to its front position, and the member temporarily holds the labels 3 when it returns to its front position. On the other hand, all of the link mechanism 44, sliding member 61, auxiliary peeling member 65, etc. thus far described may be assembled together with the cover 45 into a unit which may be removably attached with ease to one side of the hand labeler by means of screws, or the like.

Although the peeling unit 30 of both embodiments is comprised of the upper regulating members 31 and the lower regulating member 32, this construction can be simplified, for example, such that the leading edge of the platen 38 defines the peeling unit 30 around which the backing paper 2 may be turned. With this simplified construction, the feeding of the label web 1 and the peeling of the labels 3 can be effected if the feed drum 26 merely pulls the backing paper 2 after it has been turned.

The third embodiment of the present invention is now described with reference to FIGS 9–12. The label peeling device is applied to a printer, such as a measuring printer, and there is a stationary peeling member 83.

Figure 9:
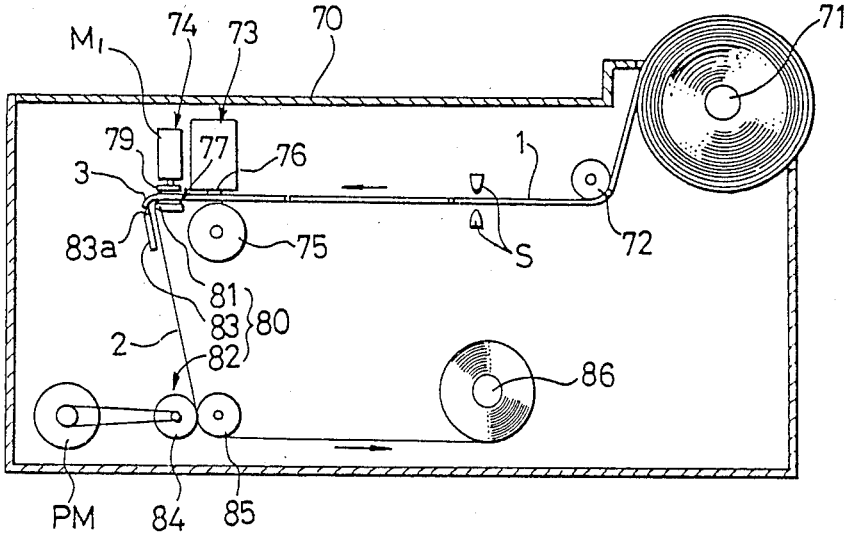

In FIG. 9, a supply unit 71 is attached to a printer body 70 for holding the label web 1 in a rolled form. The label web 1 supplied from the unit 71 is guided by a guide roller 72 and then passes over a transmission type photoelectric detector S, a printing unit 73 and a stamping unit 74.

The photoelectric detector S provides label strip feed control by detecting the perforations 6 of the label web 1 and then generating a signal. The printing unit 73 faces a platen 75. The unit 73 is equipped with a printing head 76 of the thermal printing type, for example, which prints the labels 3 with data coming from a measuring device, keyboard, or the like (not shown). The stamping unit 74 faces a stamping plate 77. The unit 74 is equipped with a stamp 79 which is driven by a solenoid $M_1$ to print the labels 3 with fixed data.

After it passes over the stamping unit 74, the label web 1 comes to a label peeling device 80 which is comprised of a peeling unit 81, a feed unit 82 and an auxiliary peeling member 83 featuring the present invention.

The peeling unit 81 uses the leading edge of the stamping plate 77 so that the backing paper web 2 of the label web 1 is deflected, i.e. turned sharply down, at the peeling unit 81 for causing the labels to be peeled from the backing paper 2.

The feed unit 82 is equipped with a drive roller 84 and a follower roller 85, which together squeeze against and pull the backing paper 2, and with a pulse motor PM for driving the drive roller 84 to rotate. The drive for the feed unit 82 is controlled by the feed signal, which is prepared on the basis of a print completion signal, by the output signal of the photoelectric detector S, and so on, thereby to feed the label web 1 as a whole by pulling its backing paper 2.

Figure 10:
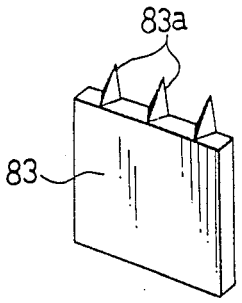

The auxiliary peeling member 83 is fixed to the printer body 70 in the vicinity of the peeling unit 81. The auxiliary peeling member 82 is a plate, as shown in FIG. 10, and is formed integrally on its upper side with a label abutment portion 83*a* comprising three teeth. The label abutment portion 83*a* is positioned in the vicinity of that portion of the peeling unit 81, at which the labels separate from the backing paper 2. A take-up unit 86 takes up the backing paper web 2 fed thereto.

The operation of this embodiment is now described.

The label web 1 is fed from the supply unit 71 in a suitably intermittent manner by the feed unit 82. The printing unit 73 and the stamping unit 74 print the respective labels 3 during the intermittent feeding with the variable data and the fixed data, respectively, at predetermined positions thereof.

The backing paper 2 being pulled by the feed unit 82 is turned at the peeling unit 81 so that the printed labels 3 are peeled one by one from their backing paper 2, due to the rigidity of the labels. However, some labels 3 fail to be peeled off by the turning of the backing paper 2 and instead turn together with the backing paper 2. Each of the labels 3, including any which fails to be completely peeled off and is about to be turned with its backing paper 2, has its leading end portion abutting against the label abutment portion 83*a* of the auxiliary peeling member 83 and this assures that the label is peeled from the backing paper 2. As noted in the above description of the first embodiment, the backing paper web is indexed so that it halts its advance with the leading end of the next label to be peeled just starting to ride over the auxiliary peeling member.

Figure 11:
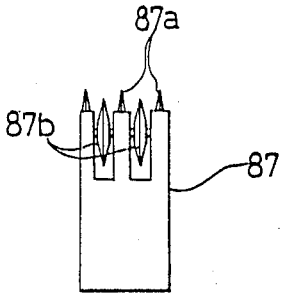

Although the auxiliary peeling member 83 is shown to be simply formed integrally with the label abutment portion 83*a*, the auxiliary peeling member 83 may be replaced wih the auxiliary peeling member 87 shown in FIG. 11, which includes rotatable beads 87*b* interposed between the adjacent teeth of the label abutment portion 87*a*. These help the forward advance of each label 3 which abuts the label abutment portion 87*a* and has been peeled off the backing paper.

Figure 12:
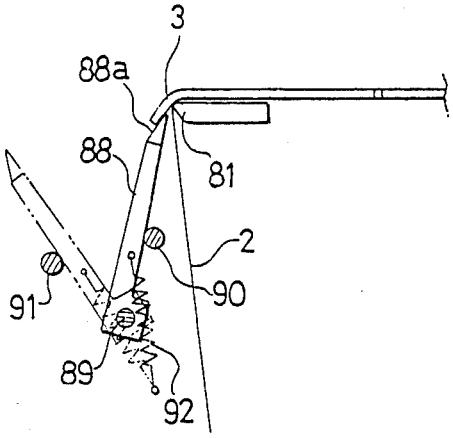

Although the auxiliary peeling member 83 is shown fixed to the printer body 70, it may alternatively be constructed as shown in FIG. 12. The auxiliary peeling member 88 has its lower end hinged by a pivot pin 89 so that the member 88 can swing between a pair of stoppers 90 and 91, fixed to the body. The member 88 is stabilized in abutment against either of the stoppers 90 and 91. During label peeling, the auxiliary peeling member 88 is held in abutment against the stopper 90. A label abutment portion 88*a* at its top, leading end is positioned at the side of the peeling unit 81. During loading of the label web 1, on the other hand, the auxiliary peeling member 88 is brought into abutment against the stopper 91, which eases label web loading.

FIGS. 13–19 show a fourth embodiment of the present invention, in which the label peeling device is also applied to a printer, such as the measuring printer. An auxiliary peeling member 93 in the vicinity of the peeling unit 81 is movable. This embodiment is similar to the foregoing third embodiment except that, in the label peeling device 80, the auxiliary peeling member 83 is fixed on the printer body 70, while the auxiliary peeling member 93 is movable. The identical parts are indicated by the same reference numerals as in the third embodiment and are not further explained.

Figure 13:
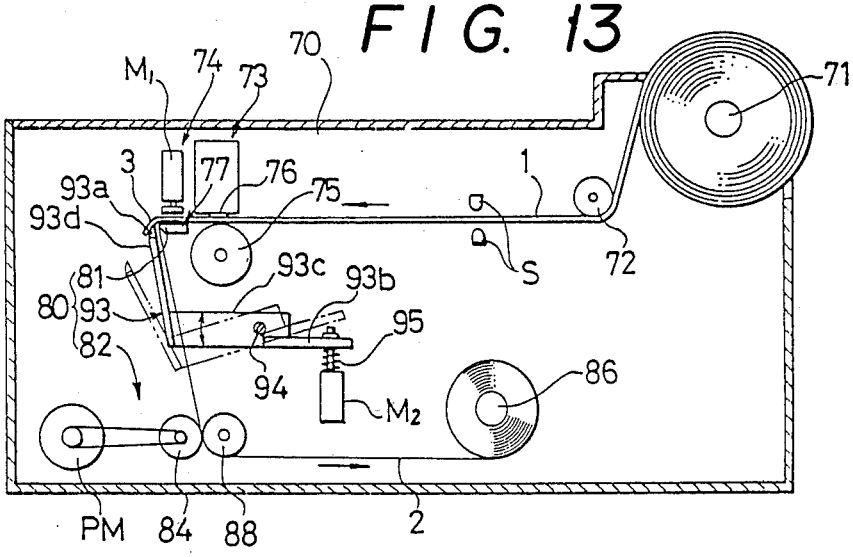
Figure 14:
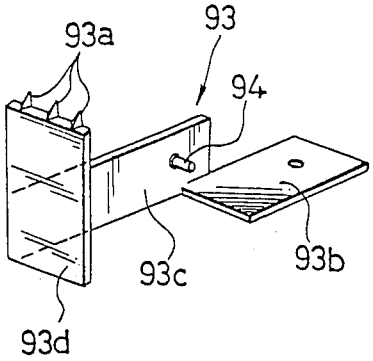

As shown in FIGS. 13 and 14, the auxiliary peeling member 93 includes a horizontal drive plate 93*b*, a vertical, forwardly extending bearing plate 93*c* and a vertical, transversely extending actuating plate 93*d*. These are integrally formed such that they mutually intersect generally at right angles. The drive plate 93*b* is connected to a solenoid $M_2$ which is mounted on the printer body 70. The bearing plate 93*c* is hinged to the body 70 by a pivot pin 94. The actuating plate 93*d* has an integral label abutment portion 93*a* with three teeth at its upper end. A spring 95 is sandwiched under compression between the solenoid $M_2$ and the drive plate 93*d* for normally urging the auxiliary peeling member 93 counterclockwise (as viewed in FIG. 13). When the solenoid $M_2$ is energized, the auxiliary peeling member 93 is rotated clockwise (as viewed in FIG. 13), and the label abutment portion 93*a* is brought to the vicinity of that portion of the peeling unit 81 where the backing paper 2 and the label 3 separate. When the solenoid $M_2$ is deenergized, the auxiliary peeling member 93 is turned counterclockwise (in FIG. 13) by the biasing force of the spring 95, moving the abutment portion away from the position at which the backing paper 2 and the label 3 separate.

In order to explain the operating timings of the auxiliary peeling member 93, which are associated with the printing operation and the feeding operation, the following description is directed to a circuit for driving and controlling the printer.

Figure 15:
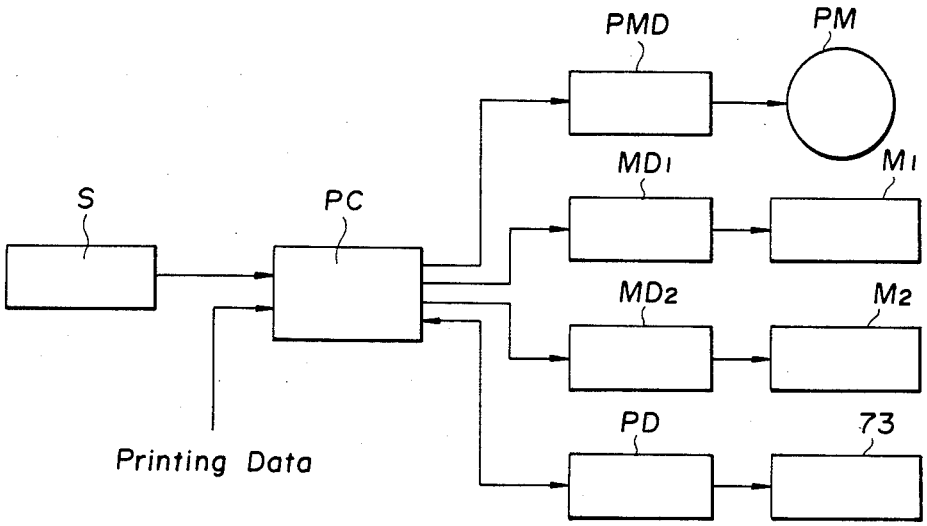

A printer controller PC which appears in FIG. 15 is used to control the printer as a whole in accordance with a program, and it is equipped with a microprocessor or the like. This printer controller PC receives the output signal coming from the photoelectric detector S and receives the printing data coming from the measuring device, keyboard, or the like (not shown).

A pulse motor driver PMD and solenoid drivers $MD_1$ and $MD_2$ drive the pulse motor PM and the solenoids $M_1$ and $M_2$, respectively, on the basis of the input signal coming from the printer controller PC. ON the other hand, a printing unit driver PD drives the printing unit 73 on the basis of the input signal coming from the printer controller PC so that the printing unit 73 may be driven to print the labels 3 with the desired variable indicia.

Figure 16:
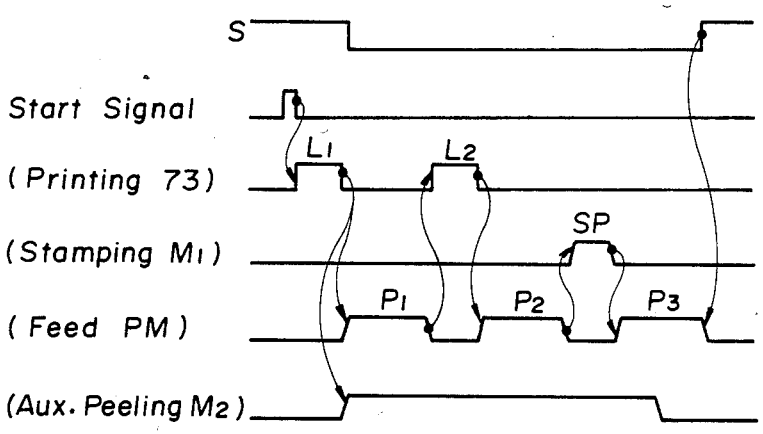

Next, the operation and timing of the auxiliary peeling member 93, which is associated with the operations of the printing unit 73, the stamping unit 74 and the feed unit 82, will be explained with reference to FIG. 16.

First, a print of first line $L_1$ is imprinted by the printing unit 73 after occurrence of the start signal. Upon completion of this first-line print $L_1$, the pulse motor PM is driven to feed the label to advance the first line $P_1$ on the label web 1. Simultaneously with the start of the feeding operation of the label web 1, the solenoid $M_2$ is also energized to rotate the auxiliary peeling member 93 clockwise from its initial position indicated by double-dotted lines in FIG. 13. The label abutment portion 93*a* of the auxiliary peeling member 93 is thus brought to a stop at that position slightly below the straight extension of the label 3, as shown by solid lines in FIG. 13, where the backing paper 2 and the label 3 first leave each other. As a result, every label, including those which fail to be completely peeled from the backing paper 2 and which turn together with the backing paper 2, has its leading end portion abut that label abutment portion 93*a* so that it is forcibly peeled off the backing paper.

When the first-line feed of the label web 1 is completed, a print of second line $L_2$ is conducted by the printing unit 73. Then another feed $P_2$ of the label web 1 is conducted. After this feed has been completed, the solenoid $M_1$ is energized for a predetermined time period so that a stamping operation SP is conducted by the stamping unit 74. During the time after completion of the stamping operation SP until the time when the signal comes from the photoelectric detector S, the final feed $P_3$ of the label web 1 is conducted. Before the completion of the final feed $P_3$, the solenoid $M_2$ is deenergized so that the auxiliary peeling member 93 is returned to its initial position by the action of the spring 95. The timing at which the solenoid $M_2$ is deenergized can be easily set not only by the monostable multivibrator (although not shown), for example, which is to be triggered at the energization time of the solenoid $M_2$ or the start time of the final feed $P_3$, but also by another method. This completes the printing and peeling of the first label 3.

Figure 17:
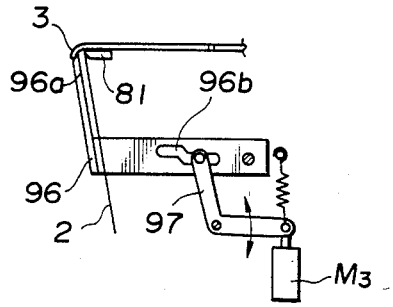

The auxiliary peeling member 93 is shown connected directly to the solenoid $M_2$. As shown in FIG. 17, however, an auxiliary peeling member 96 having a label abutment portion 96*a* may be connected to a solenoid $M_3$ indirectly through an L-shaped lever 97, which engages with a cam groove 96*b* formed in that auxiliary peeling member 96.

Figure 18:
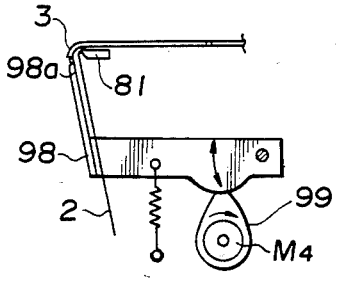

Alternatively, as shown in FIG. 18, an auxiliary peeling member 98 having a label abutment portion 98*a* may be connected to a rotary solenoid $M_4$ indirectly through a rotary cam 99 which in turn engages that auxiliary peeling member 98.

Figure 19:
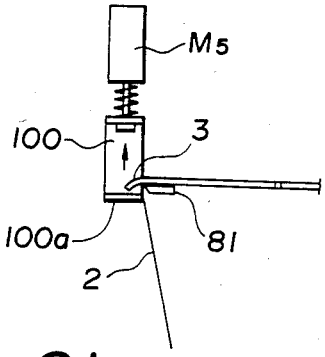
Figure 21:
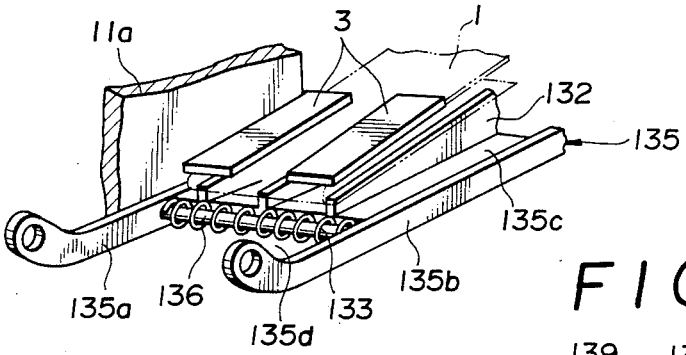
Figure 22:
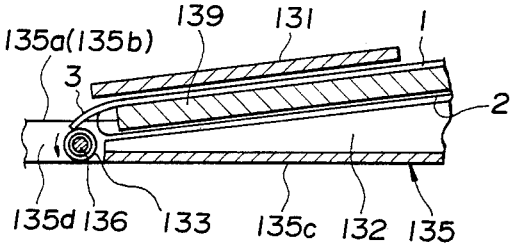
Figure 20:
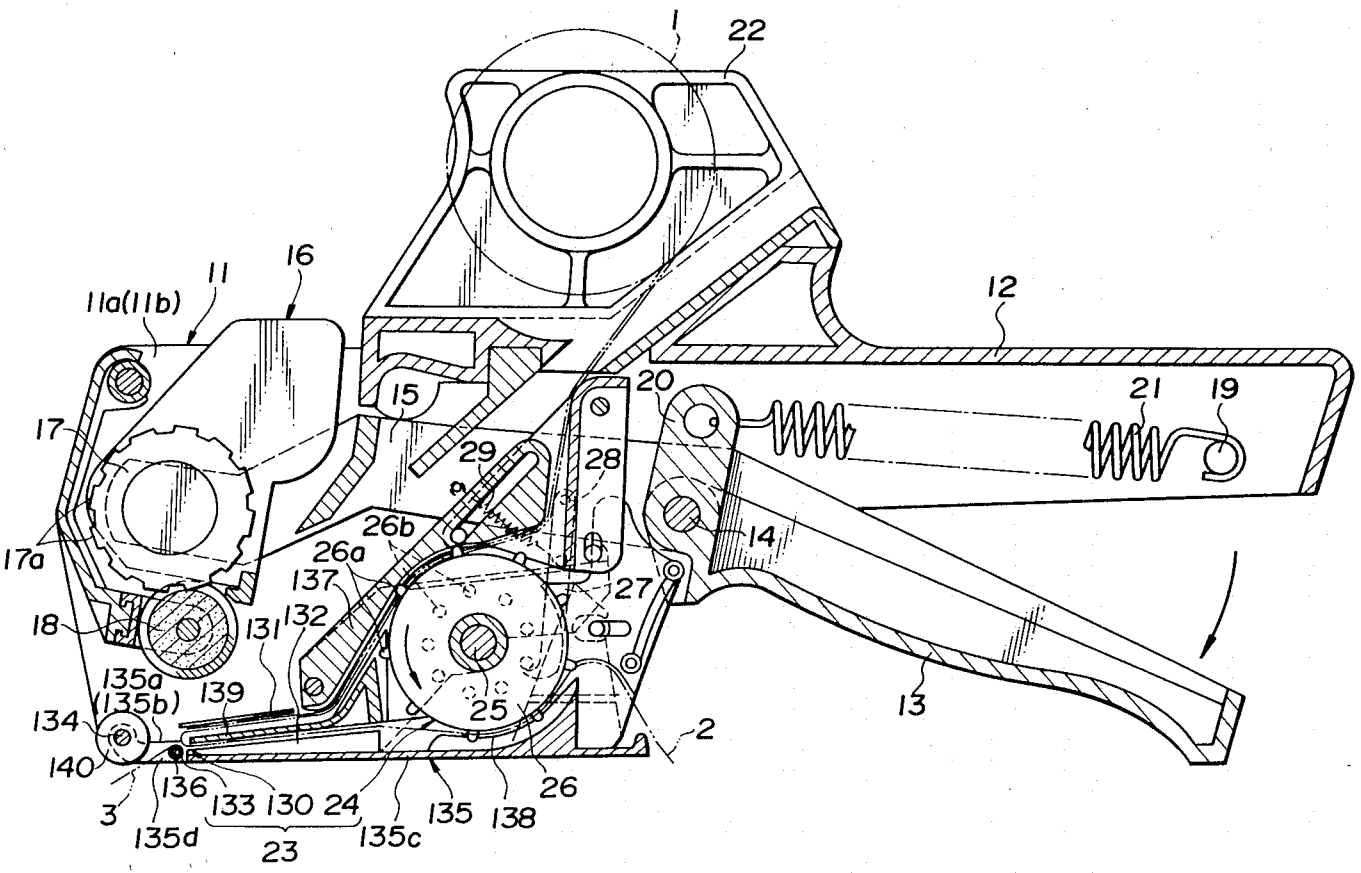

As alternatively shown in FIG. 19, an auxiliary peeling member 100 may be formed generally into the shape of a letter "C" and may be so pulled up by the action of a solenoid $M_5$ that its label abutment portion 100*a* may be moved from below to above the straight extension of the label 3 immediately after the start of the feeding operation of the label web 1. With this construction, a label, which might otherwise fail to be completely peeled from the backing paper 2, is lifted by the label abutment portion 100*a* so that it can assuredly be peeled from its backing paper.

FIGS. 20–26 show the fifth embodiment of the present invention applied to a hand labeler. Elements in this embodiment having reference numerals 1–29 correspond to those elements in FIG. 2 and are not reexplained.

The labeler body 11 is equipped with a bottom cover 135 which is comprised of two side edges 135*a* and 135*b* and a connecting plate 135*c* connecting those two side edges 135*a* and 135*b*. The bottom cover 135 is hinged in an openable manner to the two side plates 11*a* and 11*b* of the body 11.

The peeling unit 130 is equipped with upper regulating members 131, which are respectively formed integrally with the side plates 11*a* and 11*b* of the body 11, and a lower regulating member 132 which is integral with the connecting plate 135*c* of the bottom cover 135. There are juxtaposed at small gap spacing from each other the upper regulating members 131 and the lower regulating member 132, between which the backing paper 2 of the label web 1 is turned back so that the labels 3 are peeled one by one from the backing paper 2 due to their own rigidity.

The auxiliary peeling member is now described. Between the two side edges 135*a* and 135*b* of the bottom cover 135, thre is fixedly supported a pin 136 which is positioned in the vicinity of the peeling unit 130. On that pin 136 is wound an aforementioned rotary member 133 which is made of a coiled element, like a spring, of a diameter approximating that of the pin 136. The rotary member 133 coiled element is positioned in the vicinity of the position at which the backing paper 2 and the labels 3 separate, and the rotary member is free to rotate in the advancing direction of the labels 3 with respect to the pin 136. The rotary member 133 is preferably coated with a silicone resin, or the like, so as to prevent the labels 3 from sticking to it.

Upper and lower guide members 137 and 138 guide the perforations 6 of the label web 1 as a whole and the perforations 6 of only the backing paper 2 in their respective engagements with the feed pins 26*a* of the feed drum 26. The platen 139 receives the printing pressure of the printing head 16. An applying roller 140 is rotatably supported on the pivot pin 134 for applying the label 3 (which is fed out of a label aperture 135*d* formed in the bottom cover 35), to a commodity, or the like.

The operation of this embodiment is now explained. Those features described in connection with the first embodiment are not repeated.

The label web 1 is fed by the feed unit 24. Only the backing paper web 2 is turned rearwardly at the peeling unit 130. The printed label 3 is peeled from the backing paper 2 and is temporarily held on the rotary member 133 until it is applied to the commodity, or the like, by the applying roller 140.

However, all of the labels 3 may not be peeled from the backing paper 2 when the backing paper 2 is turned at the peeling unit 130. The auxiliary peeling member of the present embodiment comprises the rotary member 133 located in the vicinity of the position where the backing paper 2 and the labels 3 separate. As a result, any label 3, which does not itself completely peel from the backing paper 2 and begins to turn together with the backing paper, instead abuts the rotary member 33 and rides over the top of it to advance while also causing the rotary member 133 to rotate until the label is peeled off. Since the label 3 advances in contact with the rotary member 133, that member 33 is rotated in the advancing direction of the label. This reduces the contacting resistance of the label 3 to the rotary member so that the label 3 can be more smoothly peeled.

In this embodiment, the peeling unit 130 is comprised of the upper regulating members 131 and the lower regulating member 132. This construction can be simplified, for example, so that the leading edge of the platen 138 defines the peeling unit around which the backing paper 2 may be turned. In this construction, feeding of the labels 3 can be effected if the feed drum 26 merely pulls the backing paper 2 after it has turned rearwardly.

The rotary member 133 is shown mounted on the bottom cover 135 so that the label web 1 can be inserted by opening the bottom cover 135 to bring the rotary member 133 away from the passage of the label web 1. In the alternative, if the body 11 has its front or side portion opened and closed during the insertion of the label web 1, the rotary member 133 can be attached to that portion to be opened and closed. In yet another alternative, if the insertion of the label web 1 is facilitated by another means, the rotary member 133 can be fixed to a portion of the body 11, which can be neither opened nor closed.

Figure 23:
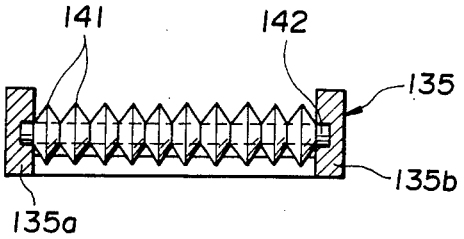
Figure 24:
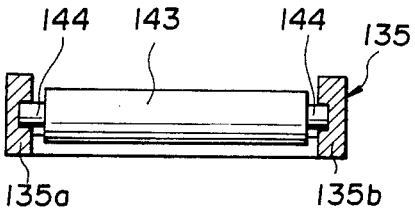
Figure 25:
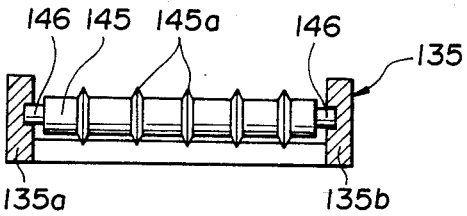
Figure 26:
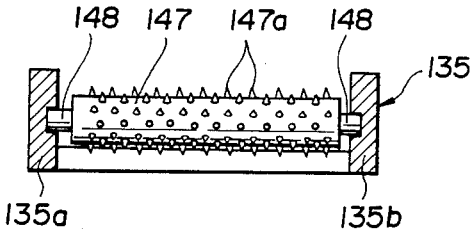

Moreover, the rotary member 133 comprises a coiled element rotatably wound on the pin 136. This may be so modified as shown in any of FIGS. 23 to 26. In FIG. 23, the rotary member 141 is comprised of a number of beads which are juxtaposed and rotatably carried on a pin 142 which is fixedly supported between the two side edges 135*a* and 135*b* of the bottom cover 135. The outer circumferences of the beads are sharpened to reduce their contact areas with the labels 3. In FIG. 24, the rotary member 143 is a roller which is integral with journals 144 that are rotatably supported between the side edges 135*a* and 135*b* of the bottom cover 135. In FIG. 25, the rotary member 145 is a roller which is integral with journals 146 that are rotatably supported similar to the modification of FIG. 24. This roller has a plurality of annular ridges 145*a* formed on its outer circumference so as to reduce its contact area with the labels 3. The rotary member 147 shown in FIG. 26 is a roller which is integral with the journals 148. The roller has a number of teeth 147*a* formed on its outer circumference for the same purpose as in FIG. 25.

Figure 27:
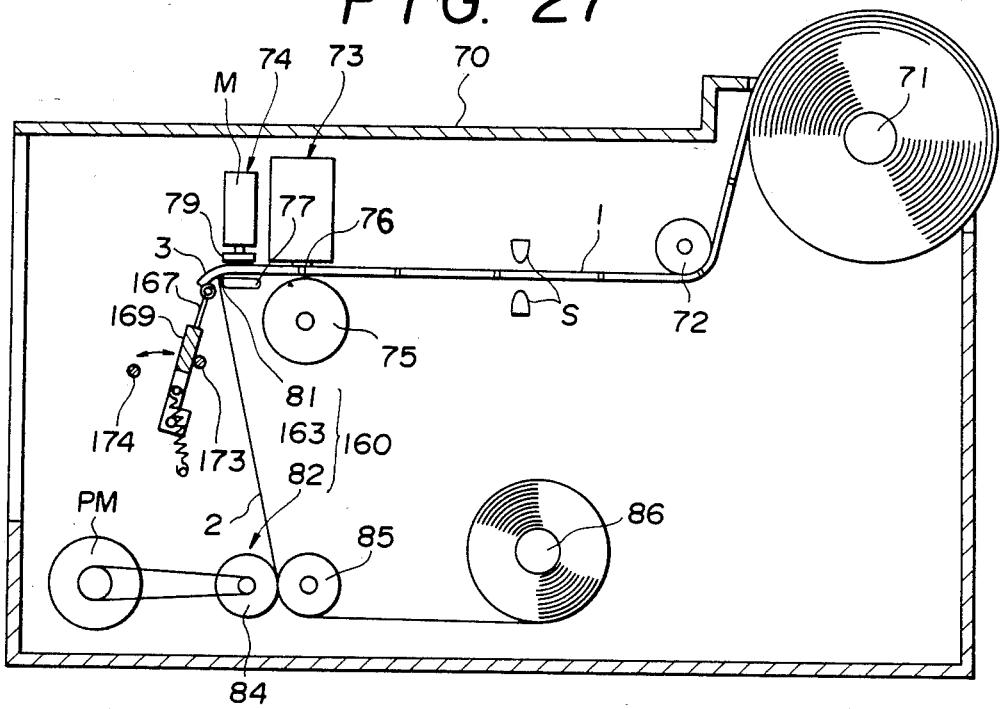

Next, the sixth embodiment of the present invention will be described with reference to FIGS. 27–29. This embodiment corresponds to the third embodiment of FIGS. 9–12 in all respects except for the label peeling device. The same reference numerals are used for the identical elements in FIGS. 27–29 and FIGS. 9–12 and only the different peeling device is described.

The label peeling device 160 is comprised of a peeling unit 81, a feed unit 82 and an auxiliary peeling member 163 featuring the present invention.

The peeling unit 81 uses the leading edge of the stamping plate 77, and the backing paper 2 of the label web 1 turns at the peeling unit 81 so that the labels 3 are peeled from that backing paper 2. The feed unit 82 has been described above.

Figure 28:
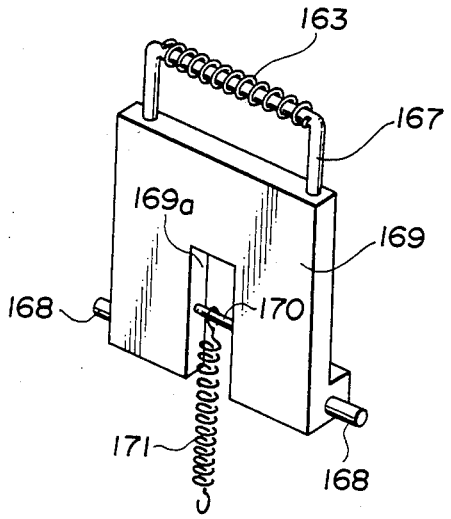
Figure 29:
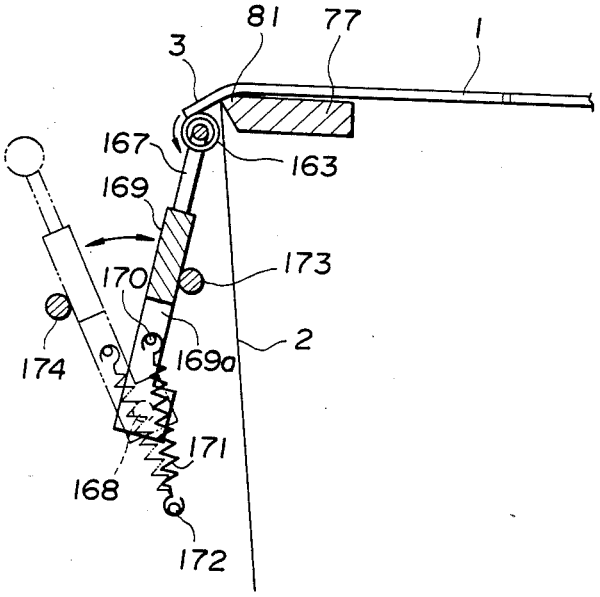

The rotary member 163, shown in FIGS. 28 and 29, comprises a coiled element, which is wound on the horizontal web section of a generally C-shaped pin 167 and the web section of the pin is supported by its legs. The pin is made swingable in the feed direction of the labels 3, as shown below. The side legs of the pin 167 are embedded in the upper side of a swingable plate 169, which is hinged to the printer body 70 by means of pivot pins 168. The rotary plate 169 has a notch 169*a* formed in its lower center portion in which a spring anchoring member 170 is fixed. A spring 171 is held under tension between that spring anchoring member 170 and a spring anchoring member 172 fixed on the body 70. As a result, the plate 169 is allowed to swing in over-center fashion between a pair of stoppers 173 and 174, which are fixed on the body 70, and the plate is stabilized when it is biased to abut against either of the stoppers 73 and 74 by the force of the spring 71. The rotary member 163 approaches that position of the peeling unit 81, where the backing paper 2 and the labels 3 separate, when the rotary plate 169 abuts the stopper 173. The rotary member is spaced far apart from the peeling unit 81 when the rotary plate 169 abuts the stopper 174.

Next, the operation of this embodiment is described. Since this operates similarly to the third embodiment, the description will be primarily directed to the auxiliary peeling member.

When the label web 1 is to be initially loaded, this is facilitated by moving the swingable plate 169 into abutment against the stopper 174. After the loading, the rotary member 163 is brought close to the label separation position, by moving the rotary plate 169 to abut the stopper 173. In this state, the previously described label printing, feeding and peeling operations are started.

The backing paper 2 being pulled by the feed unit 82 is turned at the peeling unit 81 so that the labels 3 thus printed are peeled one by one from the backing paper 2. However, some labels 3 fail to be peeled off and turn together with the backing paper 2. Every label 3 has its leading and portion abutting against the rotary member 163 and the label advances over the rotary member while rotating the member 163 until the label is peeled off without fail. Since the rotary member 163 rotates in the advancing direction of the label 3, the contacting resistance of the label 3 to the rotary member 63 is remarkably reduced so that the label can be more smoothly peeled.

This embodiment has been described wherein the rotary member 163 comprises the coiled element rotatably wound on the pin 167 embedded in the rotary plate 69. The rotary member 163 may be alternatively formed into the beads 141 or the roller 143, 145 or 147 of the embodiments shown in FIGS. 23–26, which rollers may be mounted on the plate 69.

Moreover, the pin 167 for rotatably supporting the rotary member 163 might not be embedded in a swingable plate 69 but instead may be fixed directly on the body 70, so long as the member 163 is close to the position at which the backing paper 2 and the labels 3 separate.

Although the foregoing embodiments are all equipped with printing means, this is not indispensable for the present invention. Moreover, although the feed units for feeding the label web are exemplified either by the feed drum having feed pins or by paired rollers, it is possible to adopt a construction in which the label web is fed by such feed pawls which are reciprocally movable in the horizontal direction, or another feed construction.

As has been described in connection with the foregoing embodiments, the label peeling device according to the present invention includes the auxiliary peeling member which is arranged in the vicinity of the peeling unit and which includes a label abutment portion so positioned, shaped and sized that a label, which might otherwise fail to be peeled merely by the reverse turn of the backing paper, is brought into abutment against the label abutment portion of the auxiliary peeling member until the label rides over the auxiliary member and is peeled from the backing paper. In one preferred form, the auxiliary peeling member comprises a rotary member, which is rotatable in the advancing direction of the labels.

Although the present invention has been described in connection with a plurality of preferred embodiments thereof, many variations and modifications will now become apparent to those skilled in the art. It is preferred, therefore, that the present invention be limited not by the specific disclosure herein, but only by the appended claims.

What is claimed is:

1. A label issuing machine, comprising:

a machine body; a supply unit attached to the body for supplying a label web, wherein the label web comprises a plurality of labels adhered in series to a web of backing paper;

a label peeling device for peeling each label, in turn, from the web of backing paper; the label peeling device comprising:

a peeling unit past which the label web is advanced, and the peeling unit including deflecting means for deflecting the backing paper web sharply in a direction that labels will normally separate from the backing paper web as the backing paper web advances past the deflecting means;

a feed unit for feeding the label web from the supply unit, for advancing the label web past the deflecting means, and for advancing the backing paper web beyond the deflecting means;

an auxiliary peeling member in the vicinity of the deflecting means for completing the peeling of labels which have begun to peel from the backing paper web at the lead edge of the label; the auxiliary peeling member being reciprocated from a position along the backing paper web which is spaced from the deflecting means along the part of the backing paper web after the labels have been peeled and being reciprocable toward the deflecting means and over the surface of the backing paper web from which the labels are being peeled, the peeling element being movable for engaging the leading end of any label part of which has remained adhered to the backing paper web past the deflecting means and for peeling that leading end and the label from the web of backing paper.

2. The label issuing machine of claim 1, wherein the peeling member is connected for being driven toward the deflecting means by the feed unit, such that the peeling element is driven toward the deflecting means as the label web is being advanced.

* * * * *